US005833493A

United States Patent [19]

Hung

[11] Patent Number: 5,833,493

[45] Date of Patent: Nov. 10, 1998

[54] DC POWER CONNECTING CABLE WITH ERRORPROOF INDICATION

[76] Inventor: Kuang Fu Hung, No. 1, Alley 6, Lane 190, Tehsing E. Rd., Taipei, Taiwan

[21] Appl. No.: 870,067

[22] Filed: Jun. 5, 1997

[51] Int. Cl.[6] ..... H01R 11/00

[52] U.S. Cl. ..... 439/504

[58] Field of Search ..... 439/504

[56] References Cited

U.S. PATENT DOCUMENTS

| | | | |
|---|---|---|---|
| 4,145,648 | 3/1979 | Zender | 439/504 |
| 4,420,212 | 12/1983 | Wright | 439/490 |
| 4,488,147 | 12/1984 | Signorile | 439/504 |
| 4,869,688 | 9/1989 | Merio | 439/504 |

*Primary Examiner*—Neil Abrams
*Assistant Examiner*—Barry M. L. Standig
*Attorney, Agent, or Firm*—Bacon & Thomas, PLLC

[57] ABSTRACT

A battery jumper cable with a polarity indicator is disclosed which includes a positive power and negative power connecting wire, the two ends of which are respectively disposed between donor battery end clips and depleted battery end clips for clipping the terminals of the donor and depleted batteries; and a polarity indicator including a donor battery indicating means, a depleted battery indicating means, and an override protective means. The override protective means is disposed between the clips of the positive and negative battery connecting wires. The donor and depleted battery end indicating means includes light emitting diodes positively connected between the positive and negative battery connecting wires, respectively, near the donor and depleted battery ends. When the connections to the donor and depleted battery ends are correct, the light emitting diodes are energized to emit light to indicate the correct connection. A buzzer is negatively connected in parallel between the positive and negative battery connecting wires for emitting a warning sound when the wires are incorrectly connected. When an incorrect connection causes a short circuit, the override protective means is able to disconnect the wires to prevent damage to the circuit.

4 Claims, 2 Drawing Sheets

DC POWER CONNECTING CABLE WITH ERRORPROOF INDICATION

BACKGROUND OF THE INVENTION

The present invention relates to a DC power connecting cable including light emitting elements, a buzzer and an interrupter. In the case where the wire connections to the normal and malfunctional power supplies are correct, the light emitting elements emit light to show the correct connection. In the case of incorrect connection, the buzzer emits a warning sound and the interrupter disconnects the wires from the power.

In a conventional external power jumper cable system for car, two ends of two parallel connecting wires are disposed with clips for clipping the positive and negative terminals of the normal and malfunctional batteries to form a circuit. It often happens that the clips are connected in reverse, which can result in damage to the circuit systems of both the impaired car and the rescue car.

SUMMARY OF THE INVENTION

It is a primary object of the present invention to provide a DC power connecting cable with errorproof indication including light emitting elements, a buzzer and an interrupter. In the case where the wire connections to the normal and malfunctional power supplies are correct, the light emitting elements emit light to show the correct connection. In the case of incorrect connection, the buzzer emits a warning sound and the interrupter disconnects the wires from the power supply to protect the car circuit from being damaged by high current levels.

The present invention can be best understood through the following description and accompanying drawings, wherein:

DETAILED DESCRIPTION OF THE PREFERRED EMBODIMENT

Figure 1:
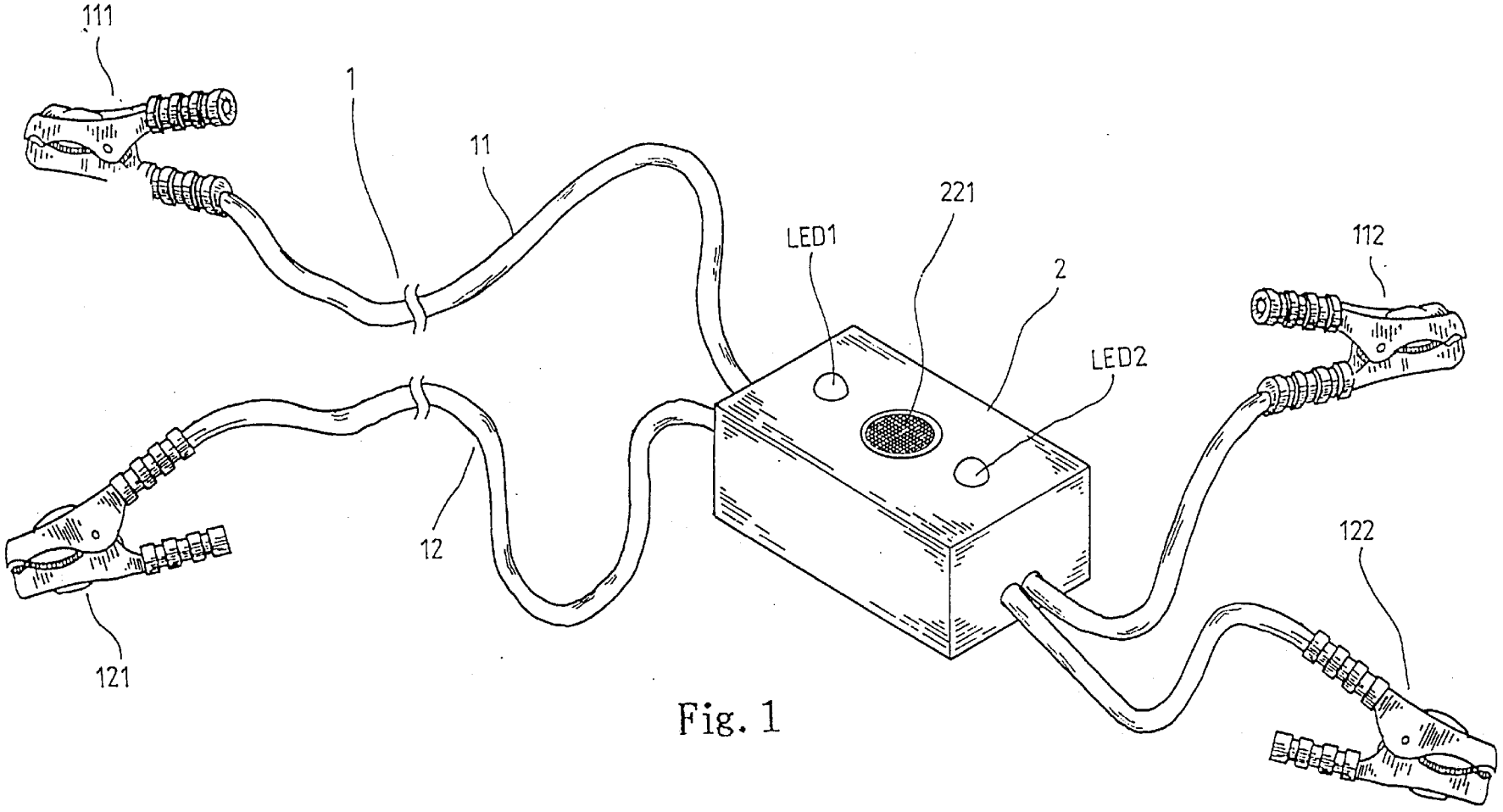
FIG. 1 is a perspective view of the present invention.
Figure 2:
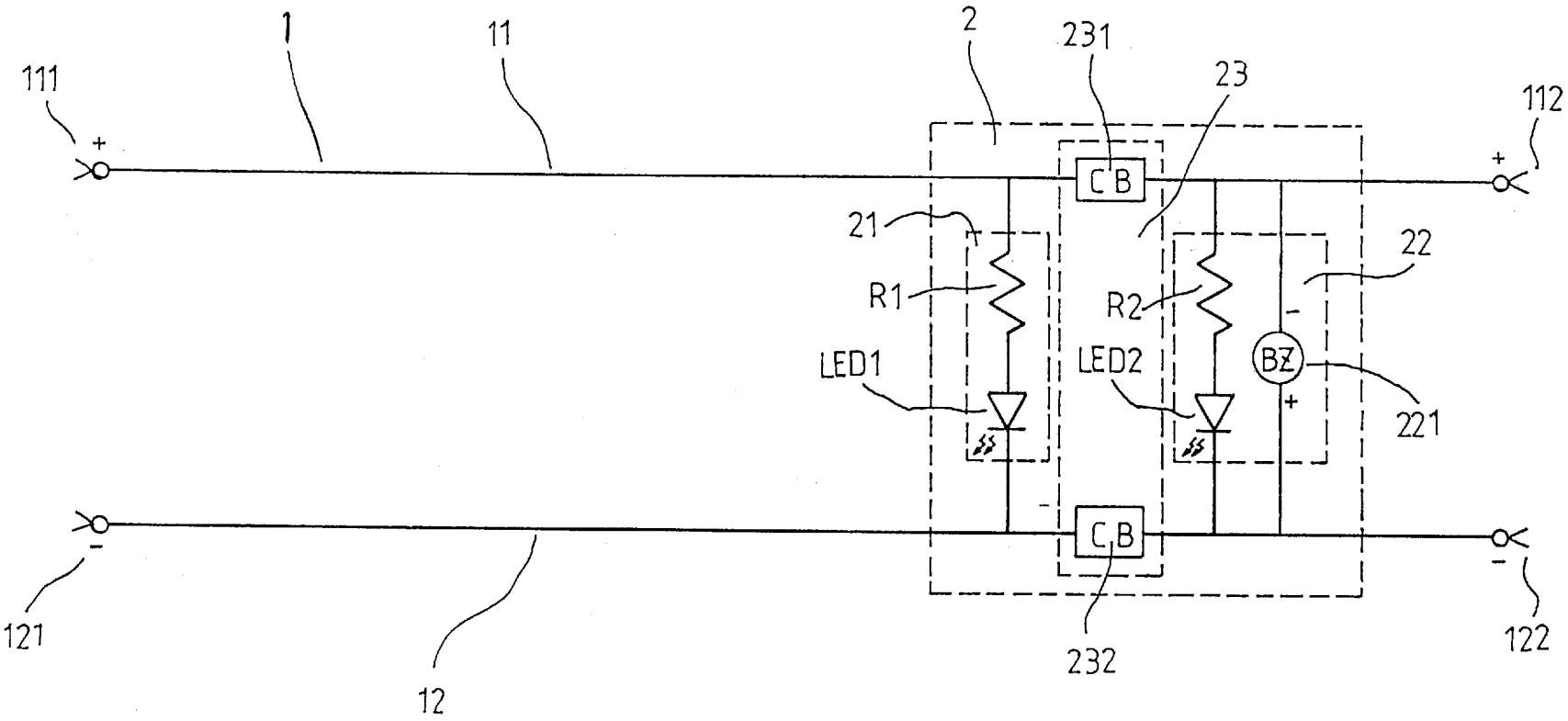
FIG. 2 is a circuit diagram of the present invention.

With reference to FIGS. 1 and 2, the present invention includes a set of battery connecting conductors 1 and a polarity indicator device 2. The battery connecting conductors 1 are composed of a positive battery connecting wire 11 and a negative battery connecting wire 12 parallel thereto. Two ends of the positive and negative power connecting wires 11, 12 are respectively disposed with donor battery end clips 111, 112 and depleted battery end clips 121, 122 for clipping the terminals of the batteries of the rescue car and the impaired car. The polarity indicator device 2 is composed of a donor battery indicating means 21, a depleted battery indicating means 22, and an override protective means 23. The override protective means 23 includes two override interrupters 231, 232 disposed between the clips of the positive and negative battery connecting wires 11, 12, respectively. The donor battery indicating means 21 is formed by a resistor R1 and a light emitting diode LED1 serially connected therewith. The LED1 is positively connected between the positive and negative battery connecting wires 11, 12 (The P pole of LED1 is connected to the positive battery terminal, while the N pole is connected to the negative battery terminal) near the donor battery end. The depleted battery end indicating means 22 is formed by a resistor R2, a light emitting diode LED2 serially connected therewith and a buzzer 221 connected in parallel with the LED2. The LED2 is positively connected between the positive and negative battery connecting wires 11, 12 near the depleted battery end of wires 11, 12. The buzzer 221 is negatively connected therebetween, beside the LED2.

In use, the clips 111, 121 of the donor battery of the connecting wires 11, 12 are used to clip the positive and negative terminals of the donor battery (for example, the battery of a rescue car). When the clips are correctly connected to the batteries, a positive bias voltage between the positive and negative battery connecting wires 11, 12 is exerted on the LED1 to energize the same. At that moment, a light is emitted to indicate that the connections to the donor battery are correct. When the clips are incorrectly connected to the batteries, the LED1 suffers a negative bias voltage and no light is emitted. At the same time, the buzzer receives a positive bias voltage, causing it to emit a warning sound. Similarly, the clips 112, 122 of the depleted battery end of the connecting wires 11, 12 are used to clip the positive and negative electrodes of the depleted battery (for example, the battery of an impaired car). When the clips are correctly connected, a positive bias voltage is exerted on the LED2 to energize the same. At the same time, a light is emitted to indicate that the connections to the depleted battery are correct. In this instance, normal charging can be performed.

When connections to the donor battery are correct and the connections to the depleted battery are incorrect, the buzzer receives a positive bias voltage, causing it to emit a warning sound. Also, a high current level will occur due to a short circuit between the positive and negative battery connecting wires 11, 12. At the same time, the override interrupters 231, 232 can disconnect the positive and negative battery connecting wires 11, 12 in time, so as to avoid damage to the circuit of either car.

It should be noted that the above description and accompanying drawings are only used to illustrate some embodiments of the present invention, and are not intended to limit the scope thereof. Any modification of the embodiments should fall within the scope of the present invention.

What is claimed is:

1. A DC power connecting cable having a polarity indicator for connecting normal and malfunctional batteries each having positive and negative polarity terminals, comprising:

a first electrical conductor including attached clips for connecting the positive terminal of the normal battery to the positive terminal of the malfunctional battery, thereby establishing a first correct connection polarity;

a second electrical conductor including attached clips for connecting the negative terminal of the normal battery to the negative terminal of the malfunctional battery, thereby establishing a second correct connection polarity;

an override protective means disposed between the clips of the first electrical conductor and between the clips of the second electrical conductor, the override protective means being able to disconnect the conductor in response to a current level which exceeds a predetermined value; and a normal battery light emitting element positively connected between the first and second conductors near the normal battery end of the conductors and a malfunctional battery light emitting element positively connected between the first and second conductors near the malfunctional battery end of the conductors, whereby the light emitting elements emit light to indicate that the first and second connection polarities are correct throughout the entire time the connection polarities are maintained.

2. The jumper cable system of claim 1, wherein the light emitting element is a light emitting diode serially connected with a current limiting device for controlling current flow through the light emitting diode.

3. The jumper cable system of claim 1, further comprising:

a buzzer negatively connected in parallel between the first and second conductors for emitting a warning sound when the first or second connection polarity is not correct.

4. The jumper cable system of claim 3, wherein the buzzer is disposed near the malfunctional battery end of the conductors adjacent the malfunctional battery light emitting element.

* * * * *